US011675313B2

(12) United States Patent
Hide et al.

(10) Patent No.: US 11,675,313 B2
(45) Date of Patent: Jun. 13, 2023

(54) TIMEPIECE MECHANISM

(71) Applicant: PATEK PHILIPPE SA GENEVE, Geneva (CH)

(72) Inventors: James Hide, Plan-les-Ouates (CH); Stéphane Oes, La Chaux-de-Fonds (CH); Frédéric Maier, Neuchâtel (CH)

(73) Assignee: PATEK PHILIPPE SA GENEVE, Geneva (CH)

( * ) Notice: Subject to any disclaimer, the term of this patent is extended or adjusted under 35 U.S.C. 154(b) by 918 days.

(21) Appl. No.: 16/603,735

(22) PCT Filed: Apr. 17, 2018

(86) PCT No.: PCT/IB2018/052644
§ 371 (c)(1),
(2) Date: Oct. 8, 2019

(87) PCT Pub. No.: WO2018/193364
PCT Pub. Date: Oct. 25, 2018

(65) Prior Publication Data

US 2021/0096513 A1 Apr. 1, 2021

(30) Foreign Application Priority Data

Apr. 18, 2017 (EP) ..... 17166832

(51) Int. Cl.
*G04B 19/243* (2006.01)
*G04B 1/22* (2006.01)
(Continued)

(52) U.S. Cl.
CPC ..... *G04B 19/2434* (2013.01); *G04B 1/12* (2013.01); *G04B 1/22* (2013.01); *G04B 15/10* (2013.01);
(Continued)

(58) Field of Classification Search
CPC ..... G04B 19/2434; G04B 19/2438; G04B 19/253; G04B 19/268; G04B 1/12;
(Continued)

(56) References Cited

U.S. PATENT DOCUMENTS 1,623,076 A 4/1927 Tremaine
3,559,395 A 2/1971 Kikuchi
(Continued)

FOREIGN PATENT DOCUMENTS

CH 702 354 6/2011
CH 703 797 3/2012
(Continued)

OTHER PUBLICATIONS

International Search Report, PCT/IB2018/052644, dated Aug. 2, 2018.
(Continued)

*Primary Examiner* — Edwin A. Leon
*Assistant Examiner* — Jason M Collins
(74) *Attorney, Agent, or Firm* — Nixon & Vanderhye

(57) ABSTRACT

A timepiece mechanism includes a first energy source with a regulating member, a second independent energy source, a control member driven by the second energy source, and a blocking device controlled by the first energy source to block the second energy source and release it to allow the control member to be displaced by jumps powered by the second energy source. The blocking device includes first and second mobile parts kinematically interconnected, the first mobile part including a drive device, the second mobile part including a stopping device; a rotating drive member connected to the first energy source and cooperating with the drive device to displace the mobile parts, alternately in opposite directions; and a rotating blocking member connected to the second energy source and cooperating with the
(Continued)

stopping device to be blocked by the second mobile part and released at the determined times by second mobile part movement.

22 Claims, 5 Drawing Sheets

(51) Int. Cl.

| | |
|---|---|
| ***G04B 15/10*** | (2006.01) |
| ***G04B 17/04*** | (2006.01) |
| ***G04B 19/253*** | (2006.01) |
| ***G04B 1/12*** | (2006.01) |
| ***G04B 19/26*** | (2006.01) |

(52) U.S. Cl.
CPC ..... *G04B 17/04* (2013.01); *G04B 19/253* (2013.01); *G04B 19/268* (2013.01)

(58) Field of Classification Search
CPC ..... G04B 1/22; G04B 15/10; G04B 17/04; G04B 15/14
See application file for complete search history.

(56) References Cited

U.S. PATENT DOCUMENTS

| | | | | |
|---|---|---|---|---|
| 7,173,883 | B2 | 2/2007 | Seyr | |
| 8,882,339 | B2 * | 11/2014 | Colpo | G04B 15/14 368/127 |
| 9,075,394 | B2 * | 7/2015 | Stranczl | G04B 15/06 |
| 9,164,483 | B2 * | 10/2015 | Laesser | G04B 15/14 |
| 10,372,082 | B2 * | 8/2019 | Semon | G04B 15/00 |
| 11,460,811 | B2 * | 10/2022 | Semon | G04B 1/22 |
| 2015/0220060 | A1 * | 8/2015 | Laesser | G04B 15/08 368/127 |
| 2017/0269551 | A1 * | 9/2017 | Semon | G04B 15/02 |
| 2018/0284697 | A1 | 10/2018 | Von Allmen et al. | |

FOREIGN PATENT DOCUMENTS

| | | | |
|---|---|---|---|
| CH | 710463 | A2 | 6/2016 |
| EP | 0620509 | A1 | 10/1994 |
| EP | 1 498 788 | | 1/2005 |
| EP | 1470452 | B1 | 10/2005 |
| EP | 1 658 531 | | 5/2006 |
| FR | 1522084 | A | 4/1968 |
| JP | S44-028931 | B | 11/1969 |
| JP | 2007-533954 | A | 11/2007 |
| WO | WO 2005/006087 | | 1/2005 |
| WO | 2011/113757 | A1 | 9/2011 |
| WO | 2013/144236 | A1 | 10/2013 |

OTHER PUBLICATIONS

Office Action issued in Japanese Patent Application No. 2019-556658 dated Feb. 2, 2022.

* cited by examiner

TIMEPIECE MECHANISM

The present invention relates to a timepiece mechanism comprising:

- a first source of energy,
- a regulating member arranged to regulate the first source of energy,
- a second source of energy independent of the first source of energy, a control member arranged to be driven by the second source of energy and to control for example a display, and
- a blocking device arranged to be controlled by the first source of energy to block the second source of energy and to release it at determined times in order to allow the control member to be displaced by jumps under the action of the second source of energy.

Mechanisms of this type are described in documents CH 702354, CH 703797 and EP 1658531. The aim thereof is to suppress or attenuate the drawing of energy from the first source of energy for displaying one or more determined values so as to prevent this displaying action from disrupting the oscillations of the regulating member or decreasing the duration of operation of a gear train driven by the first source of energy.

In document CH 702354, the first source of energy is intended exclusively for maintaining the oscillations of the regulating member, i.e. does not drive any displaying device, whilst the second source of energy is used to drive displaying devices, i.e. in particular a jumping seconds hand and indicators for the time, date and phase of the moon.

In document CH 703797, the first source of energy drives a time display via a first gear train whilst the second source of energy drives, via a second gear train, indicators for chronograph seconds, minutes counter, hours counter and jumping seconds.

In these two documents CH 702354 and CH 703797, the blocking device is in the form of a wolf-tooth wheel which is coaxial with and fixedly attached to an escape wheel of the regulating member and which co-operates with a starwheel of a jumping seconds wheel assembly. The display(s) driven by the second source of energy are dragging displays and the proposed mechanism does not allow the instantaneous displaying of a value, in particular a value which varies infrequently, such as the date. Also, the starwheel of the jumping seconds wheel assembly exerts a force on the wolf-tooth wheel, and thus on the escape wheel, which can disrupt the oscillations of the regulating member.

In document EP 1658531, the second source of energy drives, via a second gear train, a display device comprising discs indicating hours and minutes of a chronograph, and the blocking device comprises a first lever and a second lever. The first lever is raised at times determined by a minutes wheel driven by the first source of energy via a first gear train to cause the second lever to pivot so that lifts borne by the second lever release a cam and a flywheel respectively. The cam and the flywheel thus start to turn under the action of the second source of energy which causes the indicating discs to turn. The blocking device according to this document is complicated and produces a great deal of friction, in particular between the minutes wheel and the first lever and between the second lever and the cam. Moreover, if the minutes wheel stops, in the event of a shock or time-setting for example, just after having raised the first lever, the wheel assemblies of the display device continue to turn under the action of the second source of energy, the second lever not being able to descend again to stop the cam and the flywheel. The display is thus deregulated.

The present invention aims to overcome, at least in part, the disadvantages stated above and is characterised in that the blocking device comprises:

- first and second mobile parts kinematically connected to one another, the first mobile part comprising a drive device, the second mobile part comprising a stopping device,
- a rotating drive member kinematically connected to the first source of energy and arranged to co-operate with the drive device to displace the first mobile part, and thus the second mobile part, alternately in opposite directions, and
- a rotating blocking member kinematically connected to the second source of energy and arranged to co-operate with the stopping device to be blocked by the second mobile part and released at said determined times by said displacements of the second mobile part.

Other features and advantages of the present invention will become clear upon reading the following detailed description given with reference to the attached drawings in which.

Figure 1:
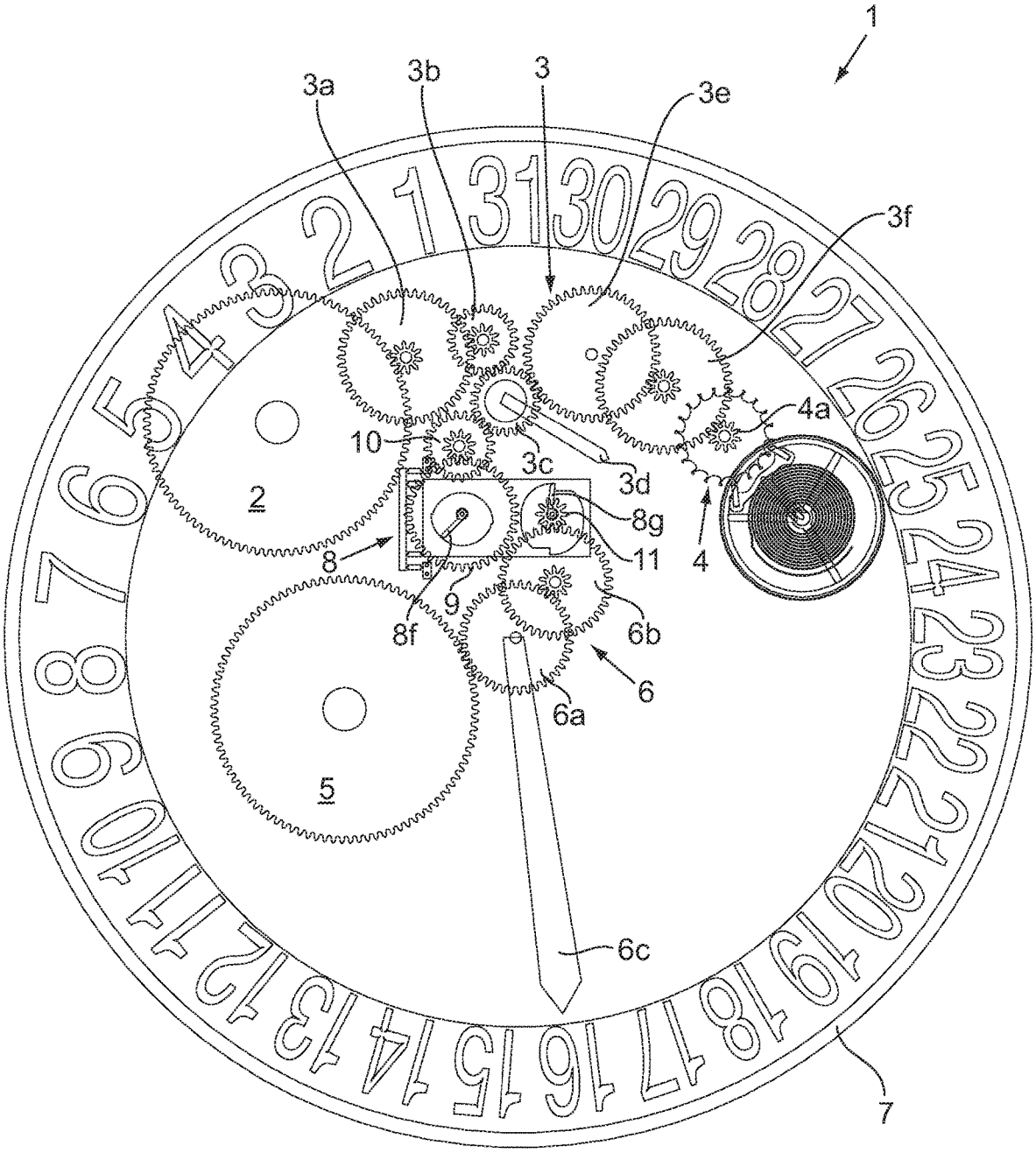
FIG. 1 is a top view of a timepiece mechanism in accordance with the invention.

With reference to FIG. 1, a timepiece mechanism 1 in accordance with the invention, for a timepiece such as a wristwatch or a pocket watch, comprises a first source of energy 2, a first gear train 3 and a regulating member 4. Typically, the first source of energy 2 is in the form of a barrel housing a mainspring and the regulating member 4 comprises a balance-hairspring and an escapement. In a conventional manner, the first source of energy 2 can be wound by the user using a manual winding mechanism and/or by an automatic winding mechanism (with oscillating mass). The first gear train 3 is a going gear train successively comprising, in the illustrated example, a great wheel-and-pinion assembly 3*a*, a third wheel-and-pinion assembly 3*b*, an hour wheel 3*c* carrying an hour-indicating hand 3*d*, an intermediate wheel 3*e* and a fourth wheel-and-pinion assembly 3*f*. The great wheel-and-pinion assembly 3*a* meshes with the barrel 2 whilst the fourth wheel-and-pinion assembly 3*f* meshes with an escapement pinion 4*a* of the regulating member 4.

The timepiece mechanism 1 further comprises a second source of energy 5 and a second gear train 6. Like the first source of energy 2, the second source of energy 5 is typically in the form of a barrel housing a mainspring. The first and second sources of energy 2, 5 are independent in the sense that neither of them provide energy to the other. In the illustrated example, the second gear train 6 comprises a date wheel 6*a* which meshes with the barrel 5 and a reducer wheel-and-pinion assembly 6*b* which meshes with the date wheel 6*a*. The date wheel 6*a* carries a date-indicating hand 6*c* directed towards a date scale 7 provided on a dial of the timepiece mechanism 1. However, as a variant, the indicating hand 6*c* could be replaced by one or more indicating discs co-operating with one or more apertures in the dial. The date wheel 6*a* is a control member in the sense of the present invention.

The timepiece mechanism 1 also comprises a blocking device 8 for blocking and releasing the second gear train 6 under the control of the first gear train 3. This blocking device 8 comprises (cf. FIGS. 1 and 2) a mobile frame 8*a* which is guided in translation along the double arrow F by a flexible guiding device 8*b*. The flexible guiding device 8*b* is known per se. It is formed of a set of rigid parts and elastic parts, the set being fixed by two 8*c* of its rigid parts to the framework of the timepiece mechanism 1 and joined to the mobile frame 8*a*. Preferably, the flexible guiding device 8*b* forms a monolithic piece with the mobile frame 8*a*. The flexible guiding device 8*b* as shown is designed to eliminate the stray translational and rotational movements such that the mobile frame 8*a* moves purely in a translational manner. However, the present invention does not exclude the use of a simpler flexible guiding device, e.g. allowing a slight rotational displacement in addition to the translational displacement.

The mobile frame 8*a* has two openings 8*d*, 8*e*, the respective contours of which are closed. The first opening 8*d* receives a drive member 8*f* in the form of a finger which is coaxial with and fixed relative to a wheel 9 which meshes with the first gear train 3 via a reducer wheel-and-pinion assembly 10. The second opening 8*e* receives a blocking member 8*g* in the form of a finger which is coaxial with, and fixed relative to, a pinion 11 which meshes with the reducer wheel-and-pinion assembly 6*b* of the second gear train 6.

Figure 2:
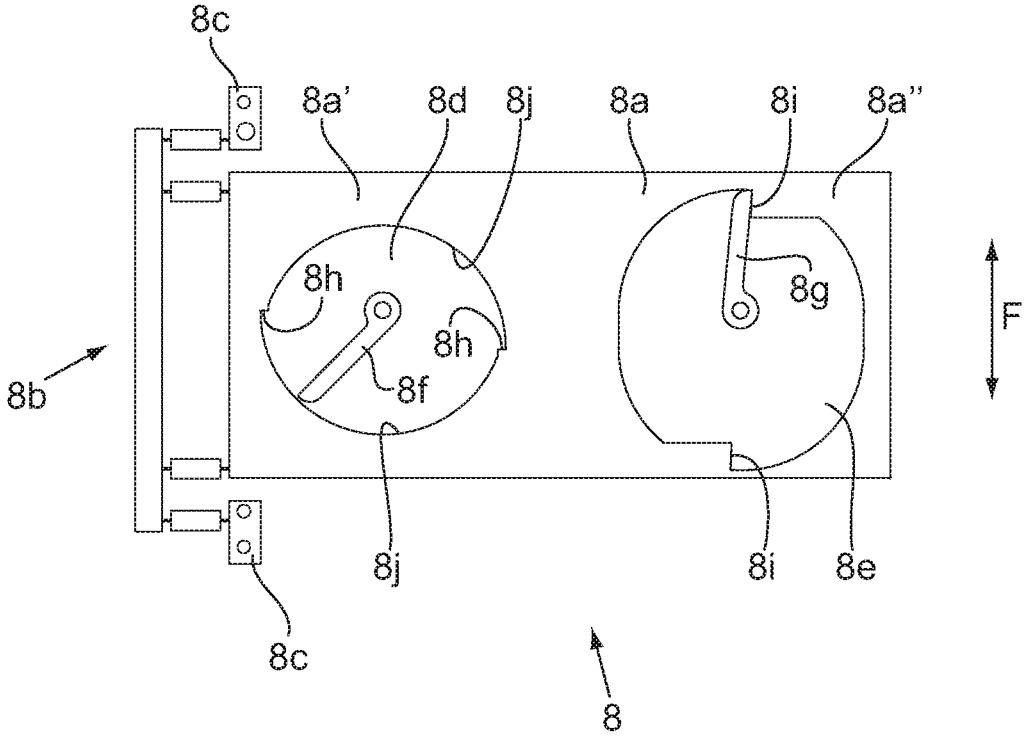
FIG. 2 shows the co-operation between a frame which can move in translation guided by a flexible guiding device, a drive member and a blocking member forming part of the timepiece mechanism in accordance with the invention; for reasons of simplification, the flexible guiding device is shown in this FIG. 2—as in FIGS. 3, 7, 8 and 9 discussed below—in a rest state whilst in practice it is deformed.

Two diametrically opposed offsets 8*h* in the wall of the first opening 8*d* form drive elements. Two diametrically opposed offsets 8*i* in the wall of the second opening 8*e* form stopping elements. Except at midnight, the blocking member 8*g*, which is tensioned by way of the torque exerted by the second source of energy 5, remains in abutment against one of the stopping elements 8*i*, which keeps the second source of energy 5, the second gear train 6 and the date-indicating hand 6*c* stationary. The drive member 8*f* is continuously driven by the first gear train 3 in the clockwise direction in FIGS. 1 and 2 at a rate of one revolution every 48 hours. Once every 24 hours, the drive member 8*f* contacts one of the drive elements 8*h* and then co-operates with it tangentially (in the manner of a gear) to displace the mobile frame 8*a* in translation during a time interval, e.g. one to two hours, overlapping midnight. At midnight, the displacement of the mobile frame 8*a* releases the blocking member 8*g* which loses the contact with the stopping element 8*i* on which it was in abutment. The second source of energy 5 is thus no longer held and the assembly 5, 6, 8*g*, 11 starts to turn until the blocking member 8*g* comes to abut against the other stopping element 8*i* and once again block the second source of energy 5 and the second gear train 6, a position in which the date-indicating hand 6*c* indicates the next date. The drive member 8*f* then leaves the drive element 8*h* with which it co-operated and continues its rotation without driving or touching the mobile frame 8*a*, the latter being immobilised by a slight draw exerted by the blocking member 8*g* on the stopping element 8*i* against which it bears—for this purpose the stopping elements 8*i* are slightly inclined—this draw compensating for the elastic return force exerted by the flexible guiding device 8*b* on the mobile frame 8*a* and being able to cause the wall of the second opening 8*e* to abut against the blocking member 8*g* as shown in FIG. 2. Then, approaching the following midnight, the drive member 8*f* contacts the other drive element 8*h* to displace the mobile frame 8*a* in translation in the other direction during a time interval overlapping midnight. At midnight, the displacement of the mobile frame 8*a* releases the assembly 5, 6, 8*g*, 11 which starts to turn, causing the date-indicating hand 6*c* to jump, until the blocking member 8*g* again abuts against the first stopping element 8*i*. The drive member 8*f* then leaves the drive element 8*h* with which it was in contact and continues its rotation without driving or touching the mobile frame 8*a* which is immobilised by the draw exerted by the blocking member 8*g*. Then, the cycle is repeated.

The displaying of the date is thus instantaneous and the energy which powers it is provided exclusively by the second source of energy 5, allowing the assembly formed by the first source of energy 2—first gear train 3—regulating member 4 to retain its duration of run and to not be disrupted by the displaying of the date. Moreover, friction is low because in normal operation the drive member 8*f* is in contact with the wall of the first opening 8*d* only when it co-operates with the drive elements 8*h*, i.e. in a cumulative manner over less than 60%, or even less than 50%, or even less than 40%, or even less than 30%, or even less than 20% of one revolution of the drive member 8*f*. In the example illustrated in FIG. 2, the contact between the drive member 8*f* and the drive elements 8*h* occurs only over about 16% (about 8% per drive element 8*h*) of one revolution of the drive member 8*f*. Furthermore, even in the event of a shock or time-setting stopping the first gear train 3, the position of the indicating hand 6*c* is secured by the abutment of the blocking member 8*g* on one of the stopping elements 8*i*.

The second source of energy 5 can have its own winding mechanism which can be actuated from outside the timepiece. Given that it is used only once per day, the second source of energy 5 also may not have a winding mechanism and can be wound only during regular maintenance of the watch, i.e. for example every five years. The use of a standard-sized barrel, or even a smaller-sized barrel, as the second source of energy 5 is sufficient to obtain a duration of run of several years, longer than the service interval.

This latter solution, i.e. with no winding mechanism which can be actuated by the user for the second source of energy 5, is preferred in the present invention. Indeed, it does not require the provision of a link between the second source of energy 5 and the exterior of the timepiece, a link which would impair the sealing tightness of the timepiece. It also does not require the second source of energy 5 to be mechanically connected to the winding mechanism of the first source of energy 2 and thus considerably simplifies the timepiece mechanism 1. Moreover, it avoids using the automatic winding mechanism of the first source of energy 2, when such an automatic winding mechanism is provided, and thus does not require the size of the oscillating mass to be increased. A still further advantage is that the second source of energy 5 can be placed much more freely in the timepiece mechanism 1, since it does not need to be in proximity to the winding mechanism of the first source of energy 2.

As shown in FIG. 2, the wall of the first opening 8*d* comprises two opposing circular arc parts 8*j* which have the same radius but different centres, the two junctions between these two parts 8*j* forming the drive elements 8*h*. The radius of the two circular arc parts 8*j* is slightly greater than the radius of the circle travelled by the end of the drive member 8*f*. Each circular arc part 8*j*, when the drive member 8*f* moves in front of it, has its centre which coincides with the centre of rotation of the drive member 8*f*. In this manner, during its rotation between the two drive elements 8*h*, the end of the drive member 8*f* follows the wall of the first opening 8*d*, thus protecting the blocking device 8 from shocks. Indeed, in the event of a shock received by the timepiece mechanism 1 which would tend to displace the mobile frame 8*a* in the direction (upwards in the configuration of FIGS. 1 and 2) which is unfavourable in terms of the blocking of the blocking member 8*g*, the wall of the first opening 8*d* immediately abuts against the end of the drive member 8*f*, which prevents release of the blocking member 8*g*. The position of the date-indicating hand 6*c* is thus secured.

Figure 3:
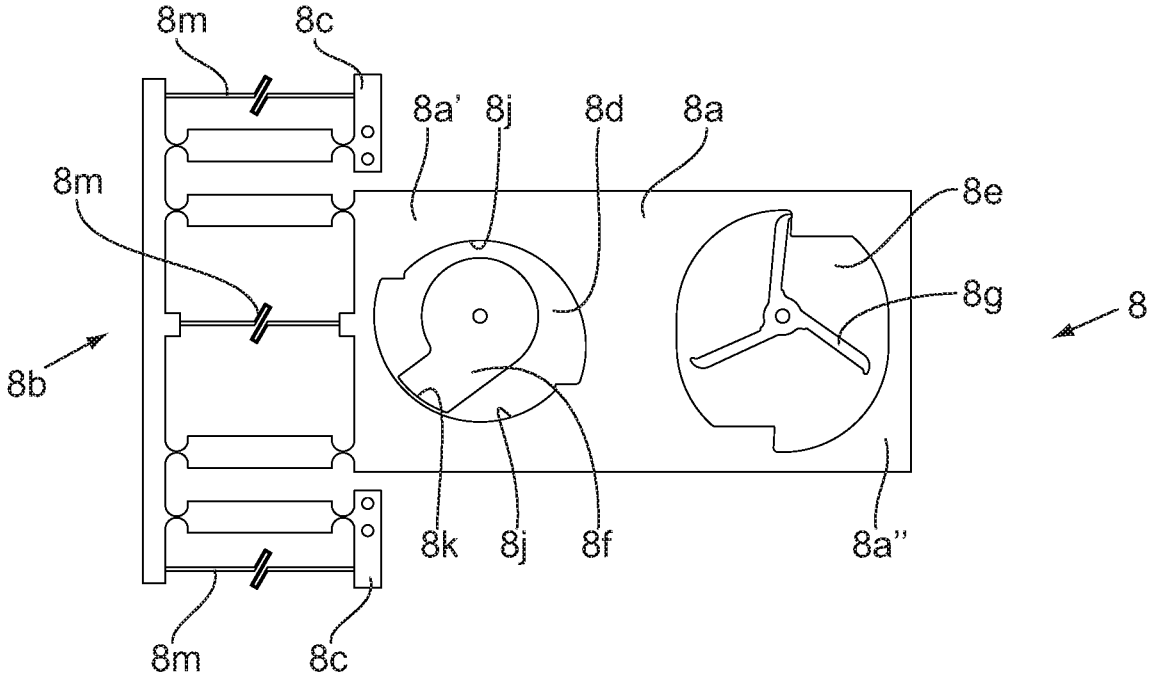
FIG. 3 shows the co-operation between a frame which can move in translation guided by a flexible guiding device, a drive member and a blocking member in accordance with one variant of the invention.

The drive 8*f* and blocking 8*g* members can each have several fingers or teeth. By way of example, FIG. 3 shows one variant of the invention in which the blocking member 8*g* is in the form of a starwheel with three teeth. Moreover, as shown in this FIG. 3, the drive member 8*f* can be a relatively wide finger and its end 8*k* can be a circular arc centred on the centre of rotation of the drive member 8*f* and with a radius slightly smaller than the radius of the circular arc parts 8*j* of the wall of the first opening 8*d*. In the event of a shock received by the timepiece mechanism 1 which would tend to displace the mobile frame 8*a* in a direction which is unfavourable in terms of the blocking of the blocking member 8*g*, the wall of the first opening 8*d* immediately abuts against the drive member 8*f*, thereby preventing release of the blocking member 8*g*.

As also shown in FIG. 3, the blocking device 8 can comprise tension springs 8*m* (shown schematically) arranged to totally or partially compensate for the return force exerted by the flexible guiding device 8*b*. The mobile frame 8*a* is thus subjected to a zero return force or a weaker return force during its translational displacements.

It goes without saying that, as an alternative to the flexible guiding device 8*b*, the mobile frame 8*a* could be mounted in a slidable manner.

In the two latter cases mentioned above, where no elastic return force is exerted on the mobile frame 8*a*, the drawing force applied by the blocking member 8*g* upon its contact with the stopping element 8*i* displaces the mobile frame 8*a* until the wall of the second opening 8*e* abuts against the blocking member 8*g*, thereby immobilising the mobile frame 8*a*.

In all the cases described above, the application of a drawing force to the mobile frame 8*a* is advantageous for minimising friction. However, the invention does not exclude the possibility of operating the blocking device 8 without a drawing force, in particular in the cases where no elastic return force is exerted on the mobile frame 8*a*.

Figure 4:
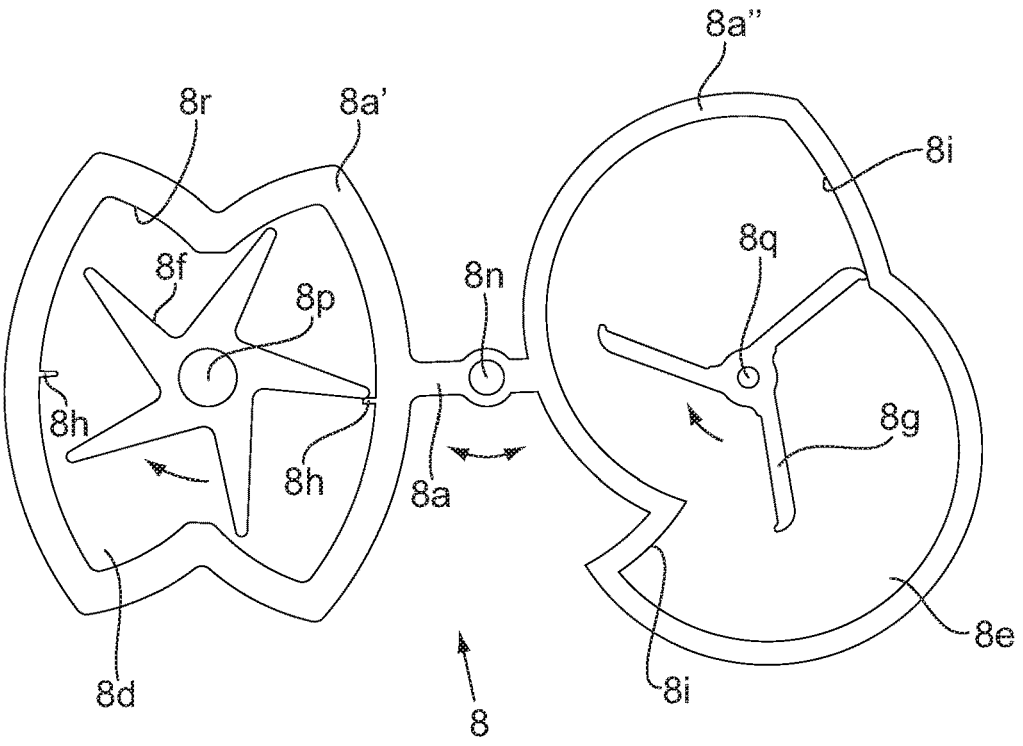
FIG. 4 shows the co-operation between a frame which can move in rotation, a drive member and a blocking member in accordance with another variant of the invention.

FIG. 4 shows another variant of the invention in which the mobile frame 8*a* is mounted to rotate about an axis 8*n* separate from the rotational axes 8*p*, 8*q* of the drive 8*f* and blocking 8*g* members. The drive 8*f* and blocking 8*g* members are here in the form of starwheels but they could also be simple fingers. The stopping elements 8*i* defined by the wall of the second opening 8*e* are circular arcs centred on the geometrical rotational axis of the mobile frame 8*a*, such that the bearing force exerted by the blocking member 8*g* on the mobile frame 8*a* is located on a straight line intersecting said geometrical rotational axis. In this manner, the fact that the blocking member 8*g* bears against the mobile frame 8*a* does not cause displacement of the latter. Nevertheless, as a variant, it is possible to incline the stopping elements 8*i* such that the blocking member 8*g* exerts on the mobile frame 8*a* a draw which immobilises the mobile frame 8*a* by compensating for possible elastic return torque applied to the mobile frame 8*a* and/or by causing the wall of the second opening 8*e* to bear against the blocking member 8*g*, as shown in FIGS. 5 and 6 for the two stopping elements 8*i*.

Figure 5:
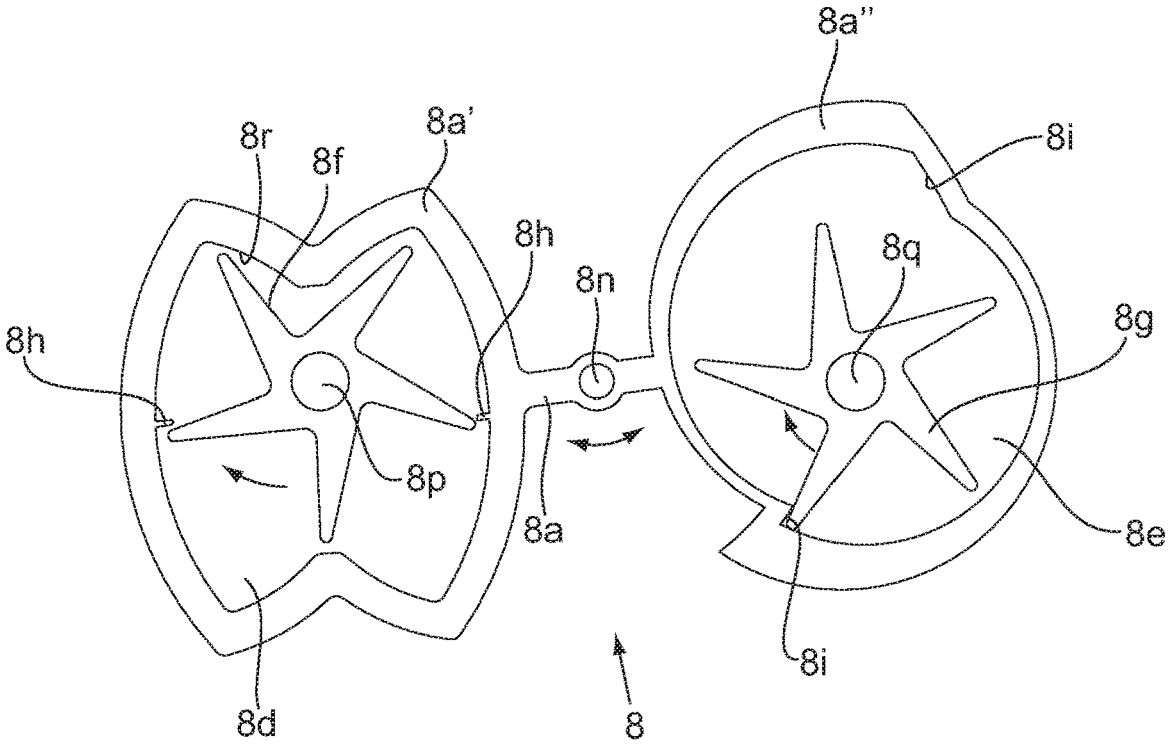
FIGS. 5 and 6 show the co-operation between a frame which can move in rotation, a drive member and a blocking member in accordance with yet another variant of the invention, with the mobile frame being in two different blocking positions.
Figure 6:
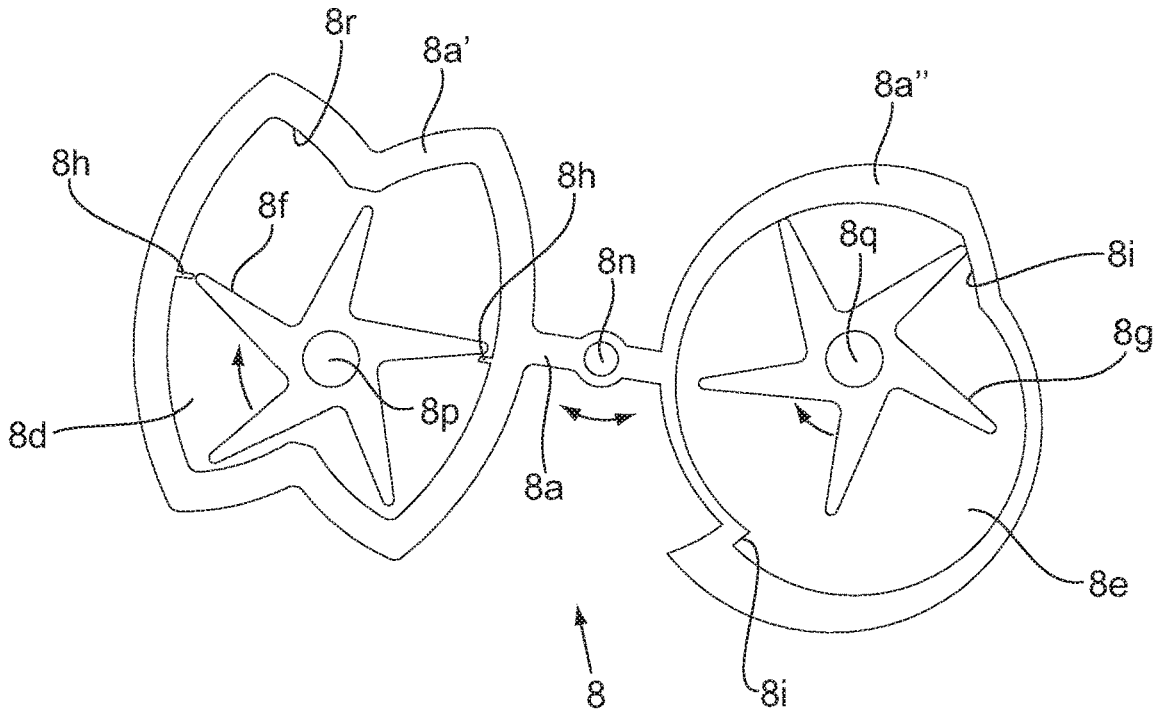

Referring to FIGS. 4 to 6, the wall 8*r* of the first opening 8*d* which receives the drive member 8*f* comprises two protrusions forming the drive elements 8*h* and is shaped to follow, over substantially 360°, the path of the tip of the finger or of a tooth of the drive member 8*f* in a coordinate system linked to the mobile frame 8*a* during rotation of the drive member 8*f*. This shape of the wall 8*r* of the first opening 8*d* allows the mobile frame 8*a* to abut immediately against the drive member 8*f* in the event of a shock in any direction and to thereby secure the blocking of the blocking member 8*g*. In the exemplified embodiments in FIGS. 1 to 3, the wall of the first opening 8*d*, with its circular arc parts 8*j*, is also shaped to follow, over substantially 360°, the path of the tip of the finger or of a tooth of the drive member 8*f* in a coordinate system linked to the mobile frame 8*a* during rotation of the drive member 8*f*.

Figure 7:
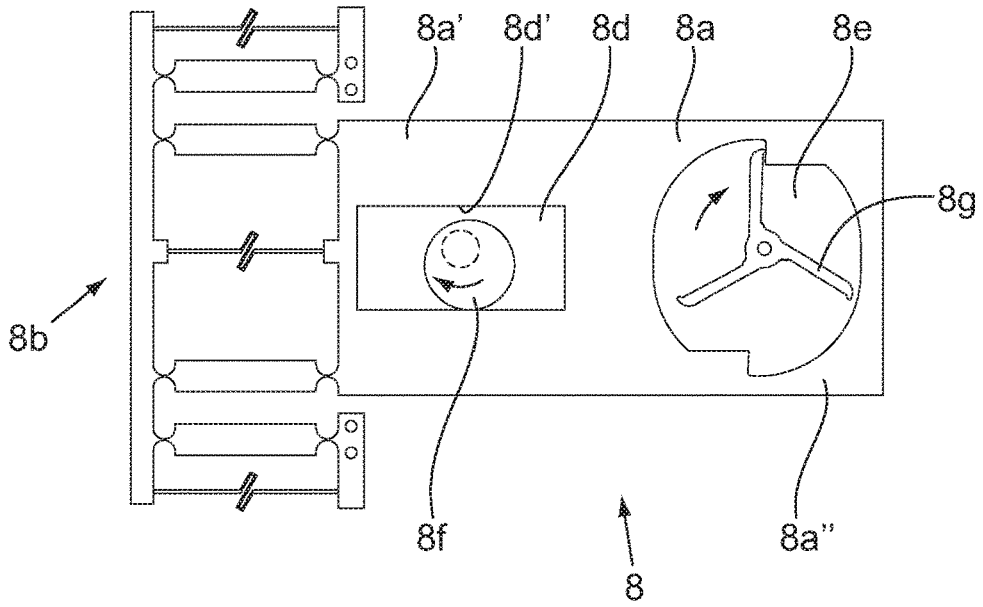
FIG. 7 shows the co-operation between a frame which can move in translation guided by a flexible guiding device, a drive member and a blocking member in accordance with yet another variant of the invention.

FIG. 7 shows yet another variant of the invention in which the drive member 8*f* is no longer in the form of a finger or a starwheel but in the form of an eccentric disc frictionally co-operating with the wall 8*d*' of the opening 8*d*. This disc 8*f* causes the mobile frame 8*a* to move reciprocally in translation, guided by the flexible guiding device 8*b*. The wall 8*d*' can have a rectangular shape, as shown, or another shape such as an ellipse.

Figure 8:
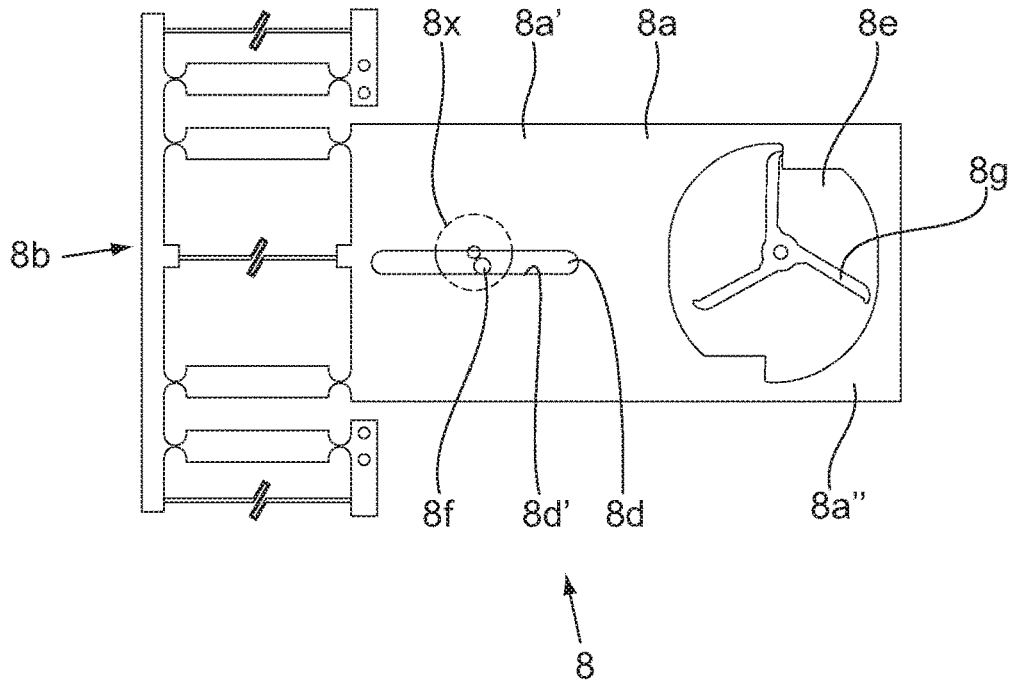
FIG. 8 shows the co-operation between a frame which can move in translation guided by a flexible guiding device, a drive member and a blocking member in accordance with yet another variant of the invention.

In yet another variant, shown in FIG. 8, the drive member 8*f* is a pin carried by a disc or wheel 8*x* and engaged in the first opening 8*d* of the mobile frame 8*a*, an opening which here is oblong in shape. By way of friction with the wall 8*d*' of the first opening 8*d*, the pin 8*f* causes the mobile frame 8*a* to move reciprocally in translation, guided by the flexible guiding device 8*b*.

Figure 9:
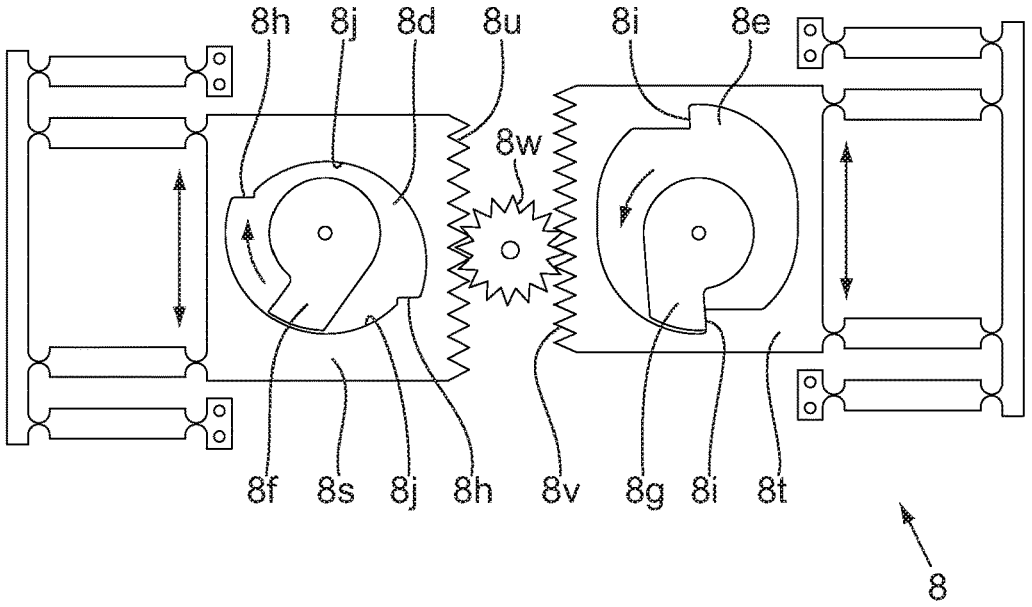
FIG. 9 shows the co-operation between two frames which can move in translation, a drive member and a blocking member in accordance with yet another variant of the invention.

FIG. 9 shows yet another variant of the invention in which the mobile frame 8*a* is replaced by two frames 8*s*, 8*t* which can move with respect to the framework of the timepiece mechanism 1 and can move with respect to each other. The first frame 8*s* comprises the first opening 8*d* which receives the drive member 8*f* and the second frame 8*t* comprises the second opening 8*e* which receives the blocking member 8*g*. These frames 8*s*, 8*t* are for example guided by respective flexible guiding devices and are kinematically connected to one another. In the illustrated example, the frames 8*s*, 8*t* are movable in translation and comprise respective racks 8*u*, 8*v* which mesh with a starwheel 8*w*. In variants, the frames 8*s*, 8*t*, or only one of them, could be movable in rotation.

By analogy with the exemplified embodiment of FIG. 9, it can be considered that the mobile frame 8*a* of FIGS. 1 to 8 comprises first and second mobile frames or parts 8*a*', 8*a*", these mobile frames or parts 8*a*', 8*a*" respectively having first and second openings 8*d*, 8*e* and being fixed relative to one another, thus kinematically connected to one another, and more particularly forming part of the same monolithic piece.

Numerous configurations other than those shown in the figures and described above are possible in the present invention. For example, instead of being coplanar, the openings 8*d*, 8*e* could be superimposed. The openings 8*d*, 8*e* could also be replaced by arms bearing tips fulfilling the function of the drive elements 8*h* and the stopping elements 8*i*. Furthermore, more than two drive elements 8*h* and/or more than two stopping elements 8*i* could be provided. For example, the wall of the first opening 8*d* could define additional drive elements to allow pre-winding of the mobile frame 8*a* or of the part 8*a*' prior to its displacement causing the release of the blocking member 8*g*.

The present invention is not limited to displaying the date. Indeed, it will be clear to a person skilled in the art that values or information other than the date can be displayed with the mechanism in accordance with the invention, such as the phase of the moon, the week, the day of the week or the month. The present invention can also be used not for displaying a value or information but for triggering a mechanism such as a striking mechanism.

The invention claimed is:

1. Timepiece mechanism (1) comprising:

a first source of energy (2), a regulating member (4) arranged to regulate the first source of energy (2), a second source of energy (5) independent of the first source of energy (2), a control member (6*a*) arranged to be driven by the second source of energy (5), a blocking device (8) arranged to be controlled by the first source of energy (2) to block the second source of energy (5) and to release it at determined times in order to allow the control member (6*a*) to be displaced by jumps under the action of the second source of energy (5), wherein the blocking device (8) comprises:

first and second mobile parts (8*a*', 8*a*"; 8*s*, 8*t*) kinematically connected to one another, the first mobile part (8*a*'; 8*s*) comprising a drive device (8*h*; 8*d*'), the second mobile part (8*a*"; 8*t*) comprising a stopping device (8*i*), a rotating drive member (8*f*) kinematically connected to the first source of energy (2) and arranged to co-operate with the drive device (8*h*; 8*d*') to displace the first mobile part (8*a*'; 8*s*), and thus the second mobile part (8*a*"; 8*t*), alternately in opposite directions, and a rotating blocking member (8*g*) kinematically connected to the second source of energy (5) and arranged to co-operate with the stopping device (8*i*) to be blocked by the second mobile part (8*a*"; 8*t*) and released at said determined times by said displacements of the second mobile part (8*a*"; 8*t*).

2. Timepiece mechanism as claimed in claim 1, wherein the first and second mobile parts (8*a*', 8*a*") are fixed relative to one another.

3. Timepiece mechanism as claimed in claim 2, wherein the first and second mobile parts (8*a*', 8*a*") form or are part of a same monolithic piece (8*a*).

4. Timepiece mechanism as claimed in claim 1, wherein the first and second mobile parts (8*s*, 8*t*) can move with respect to each other.

5. Timepiece mechanism as claimed in claim 1, wherein the stopping device (8*i*) is arranged such that the co-operation between the rotating blocking member (8*g*) and the stopping device (8*i*) immobilises the second mobile part (8*a*"; 8*t*) and thus the first mobile part (8*a*'; 8*s*) when the rotating drive member (8*f*) does not co-operate with the drive device (8*h*; 8*d*').

6. Timepiece mechanism as claimed in claim 1, wherein during normal operation, the rotating drive member (8*f*) is in contact with the first mobile part (8*a*'; 8*s*) only when it co-operates with the drive device (8*h*), i.e. over less than 60% of one revolution of the rotating drive member (8*f*).

7. Timepiece mechanism as claimed in claim 1, wherein the first mobile part (8*a*'; 8*s*) has an opening (8*d*) with a closed contour receiving the rotating drive member (8*f*) and the wall of which defines the drive device (8*h*; 8*d*').

8. Timepiece mechanism as claimed in claim 7, wherein the wall of the opening (8*d*) of the first mobile part (8*a*'; 8*s*) follows, over substantially 360°, the path of a tip of the rotating drive member (8*f*) in a coordinate system linked to the first mobile part (8*a*'; 8*s*) during rotation of the rotating drive member (8*f*) to protect the blocking device (8) from shocks.

9. Timepiece mechanism as claimed in claim 7, wherein the wall of the opening (8*d*) of the first mobile part (8*a*'; 8*s*) comprises two opposing circular arc parts (8*j*) which have the same radius but different centres, the junctions between these two circular arc parts (8*j*) forming the drive device (8*h*).

10. Timepiece mechanism as claimed in claim 7, wherein the rotating drive member (8*f*) is in the form of an eccentric disc.

11. Timepiece mechanism as claimed in claim 7, wherein the rotating drive member (8*f*) is in the form of a pin.

12. Timepiece mechanism as claimed in claim 1, wherein the rotating drive member (8*f*) is in the form of a finger or a starwheel.

13. Timepiece mechanism as claimed in claim 1, wherein the second mobile part (8*a*"; 8*t*) has an opening (8*e*) with a closed contour receiving the rotating blocking member (8*g*) and the wall of which defines the stopping device (8*i*).

14. Timepiece mechanism as claimed in claim 1, wherein the rotating blocking member (8*g*) is in the form of a finger or a starwheel.

15. Timepiece mechanism as claimed in claim 1, wherein the drive device (8*h*) comprises first and second drive elements.

16. Timepiece mechanism as claimed in claim 1, wherein the stopping device (8*i*) comprises first and second stopping elements.

17. Timepiece mechanism as claimed in claim 1, wherein the first and second mobile parts (8*a*', 8*a*"; 8*s*, 8*t*) are each movable in translation.

18. Timepiece mechanism as claimed in claim 1, wherein the first and second mobile parts (8*a*', 8*a*") are each movable in rotation.

19. Timepiece mechanism as claimed in claim 1, wherein the first and second mobile parts (8*a*', 8*a*"; 8*s*, 8*t*) are guided by one or more flexible guiding devices (8*b*).

20. Timepiece mechanism as claimed in claim 19, wherein the flexible guiding device(s) (8*b*) is/are arranged to allow displacement of the first and second mobile parts (8*a*', 8*a*"; 8*s*, 8*t*) only in translation.

21. Timepiece mechanism as claimed in claim 1, wherein the control member (6*a*) is arranged to control an indication of the date, week, day of the week, month or phase of the moon, or to control a striking mechanism.

22. Timepiece mechanism as claimed in claim 1, wherein the second source of energy (5) is not associated with any winding mechanism which can be actuated by the user.

* * * * *